US005703607A

United States Patent [19]

Tai

[11] Patent Number: 5,703,607

[45] Date of Patent: Dec. 30, 1997

[54] DRIVE CIRCUIT FOR DISPLAYING SEVEN-SEGMENT DECIMAL DIGIT

[75] Inventor: Wen-Chung Tai, Taoyuan, Taiwan

[73] Assignee: Acer Peripherals, Inc., Taipei, Taiwan

[21] Appl. No.: 622,959

[22] Filed: Mar. 27, 1996

[51] Int. Cl.[6] ..... G09G 3/14

[52] U.S. Cl. ..... 345/34; 345/33; 345/38; 368/84

[58] Field of Search ..... 345/33, 34, 38; 368/84

[56] References Cited

U.S. PATENT DOCUMENTS

| | | | |
|---|---|---|---|
| 3,802,182 | 4/1974 | Fujita | 58/50 |
| 3,855,783 | 12/1974 | Luce | 58/50 |
| 4,064,687 | 12/1977 | Kashio | 58/4 |
| 4,091,609 | 5/1978 | Ishikawa et al. | 58/23 |
| 4,205,516 | 6/1980 | Terao | 368/29 |
| 4,482,894 | 11/1984 | Matsui et al. | 340/756 |
| 4,647,924 | 3/1987 | Naqib | 340/756 |
| 5,396,259 | 3/1995 | Pang et al. | 345/34 |

*Primary Examiner*—Mark R. Powell
*Assistant Examiner*—Vincent E. Kovalick
*Attorney, Agent, or Firm*—Meltzer, Lippe, Goldstein, et al.

[57] ABSTRACT

A drive circuit for displaying the partition symbol intermittently comprising at least a pair of buffers, a plurality of display units of seven-segment, a partition symbol display buffer, a control circuit, a display unit of partition symbol, is provided. The pair of buffers store a set of signals. Each of the plurality of display units of seven-segment includes a first display portion and a second display portion, and, responsive to the set of signals, the first display portion and the second display portion are enabled to display. The partition symbol display buffer has an output value. The control circuit resets and sets the partition symbol display buffer in accordance with a predetermined manner. The display unit of partition symbol, in response to the output value, displays the partition symbol intermittently.

2 Claims, 3 Drawing Sheets

DRIVE CIRCUIT FOR DISPLAYING SEVEN-SEGMENT DECIMAL DIGIT

TECHNICAL FIELD OF INVENTION

The present invention relates to a drive circuit for intermittently lighting up the partition symbol commonly found in LCD time display.

BACKGROUND OF INVENTION

The conventional approach of seven-segment LCD display of decimal digit typically employs a pair of data buffers for storing the corresponding display information. As shown in FIG. 1(A) and FIG. 2, the first buffer outputs a logic HIGH through $SEG_n$ signal to enable the portions of 1, 2, 3, 8, and the second buffer outputs a logic HIGH through $SEG_{n+1}$ signal to enable the portions of 4, 5, 6, 7. The timing signals $com_0$, $com_1$, $com_2$, $com_3$ are enabled at distinct time point which matches with the timing of output bits, i.e., bit3, bit2, bit1, bit0, from the buffer. As timing signal $com_0$ is enabled, the segments connected to the $com_0$ signal are enabled as shown in FIG. 1(B). As timing signal $com_1$ is enabled, the segments connected to the $com_1$ signal are enabled. As timing signal $com_2$ is enabled, the segments connected to the $com_2$ signal are enabled. As timing signal $com_3$ is enabled, the segments connected to the $com_3$ signal are enabled. However, only the portions of segment are lit up which are enabled both by timing signal and the signal $SEG_n$ or signal $SEG_{n+1}$. To the contrary, as timing signal is enabled but the output from the buffer is logic LOW, or the output from the buffer is logic HIGH but the timing signal is not enabled, the corresponding segment is dark.

As the decimal digit currently displayed is to be altered, one must change the contents within the corresponding buffer. For instance, to change the most right-hand side digit "6" in FIG. 2 into "1", the contents (0110,0000) must be written into the buffers located at 1E0H and 1E1H respectively. In other words, the conventional approach involves the alteration of the contents within the corresponding buffer when changing the display of decimal digit.

In most electronic devices having LCD display capability usually display the current time, i.e., hour and minute, under program control. And the display hour and minute are typically spaced by a partition symbol ":" which is lit up intermittently. Based on the LCD display of conventional approach mentioned above, one has to alter the contents of the corresponding buffer on a regular basis which, in typical, accomplished by a microprocessor in a normal operation state. The normal operation state contrasts to the standby or sleep states in a energy saving electronics system well known in the art. When the associated circuits in the states of standby or sleep, the contents of buffer may not be altered thereby the flickering effect of the partition symbol can not be achieved. That is, to achieve the flickering effect of the partition symbol, the microprocessor must enters into the normal operation state from the standby or sleep states and thereafter changes the contents of the buffer on a regular basis. This process will definitely consumes more power than that without entering the normal state and therefore shortens the life of the battery supplying the power to the system.

Therefore, it is the main object of the invention to provide a flickering display readout when the microprocessor of the system is in states of standby or sleep mode.

SUMMARY OF INVENTION

A drive circuit for a decimal-digit display comprises at least a pair of buffers, a plurality of display units of seven-segment, a partition symbol display buffer, a control circuit and a display unit of partition symbol.

The pair of buffers store a set of signals. Each of the plurality of display units of seven-segment includes a first display portion and a second display portion, and, responsive to the set of signals, the first display portion and the second display portion are enabled respectively to display.

The partition symbol display buffer has an output value. The control circuit resets and sets the partition symbol display buffer in accordance with a predetermined manner. The display unit of partition symbol, in response to the output value, displays the partition symbol intermittently.

DETAILED DESCRIPTION OF THE INVENTION

The present invention provides a drive circuit by which the corresponding buffer to a LCD partition symbol may be set or reset to directly change the output value of the buffer without the aid of a microprocessor in sleep or standby modes.

Figure 1A:
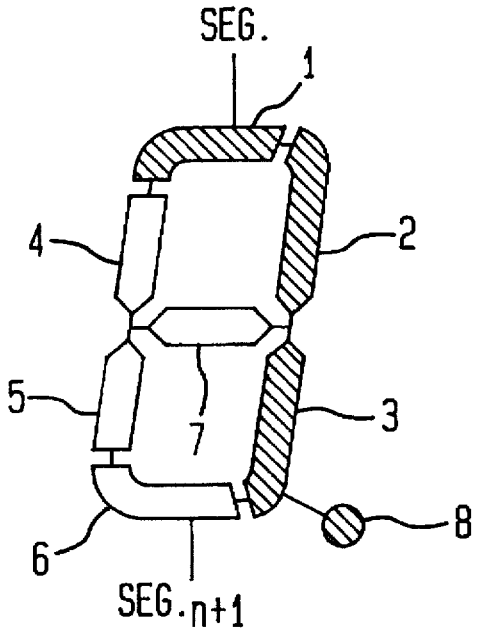
FIG. 1(A) illustrates the portion of segments controlled by signals $SEG_n$ and $SEG_{n+1}$.
Figure 1B:
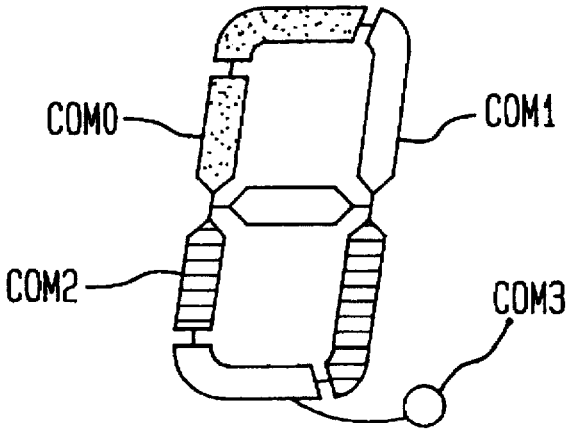
FIG. 1(B) illustrates the portion of segments controlled by timing signals $com_0$, $com_1$, $com_2$ and $com_3$ respectively.
Figure 2:
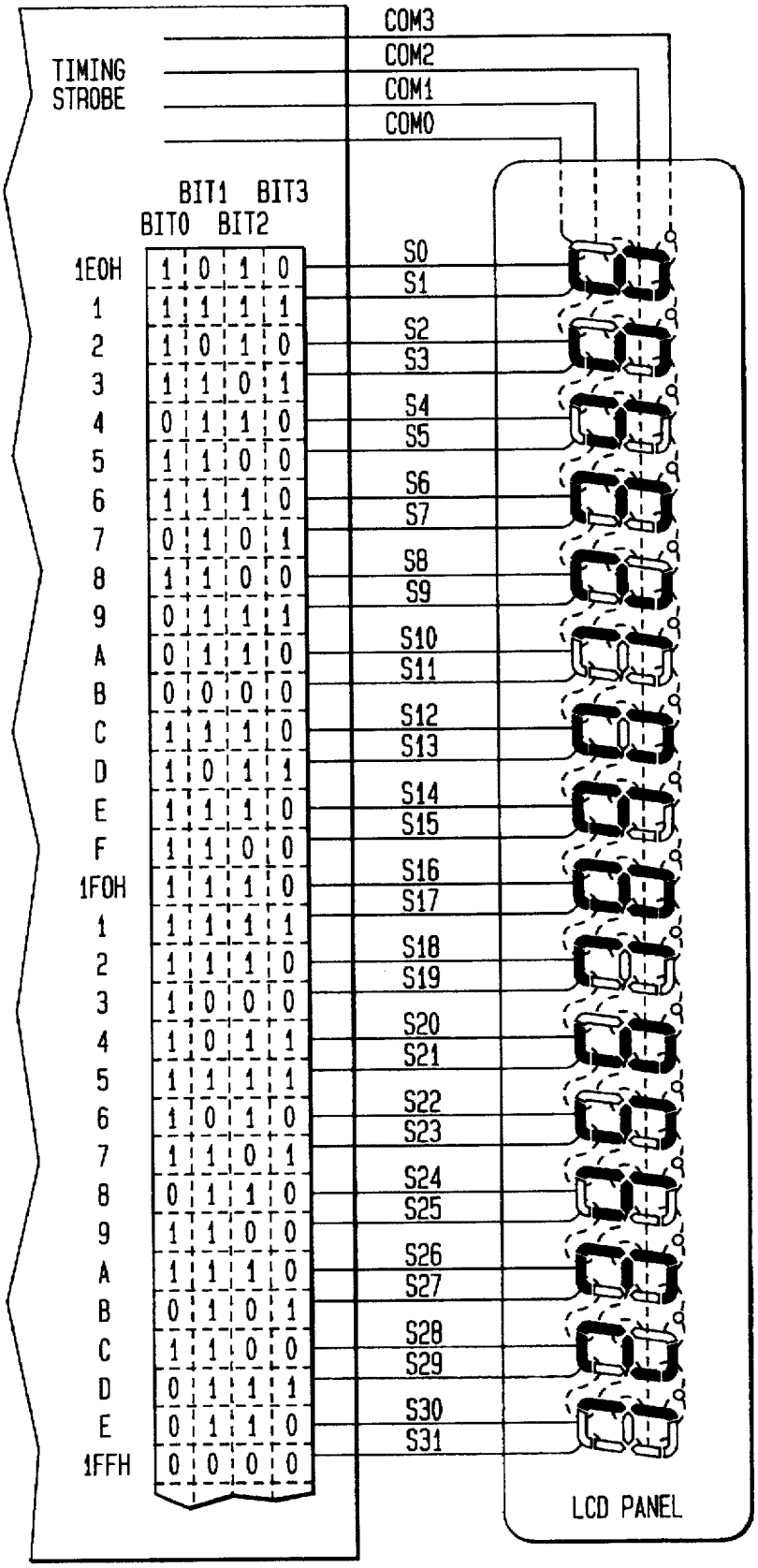
FIG. 2 illustrates the relationship between the data buffer, display segments, and the timing signals $com_0$, $com_1$, $com_2$, $com_3$.
Figure 3:
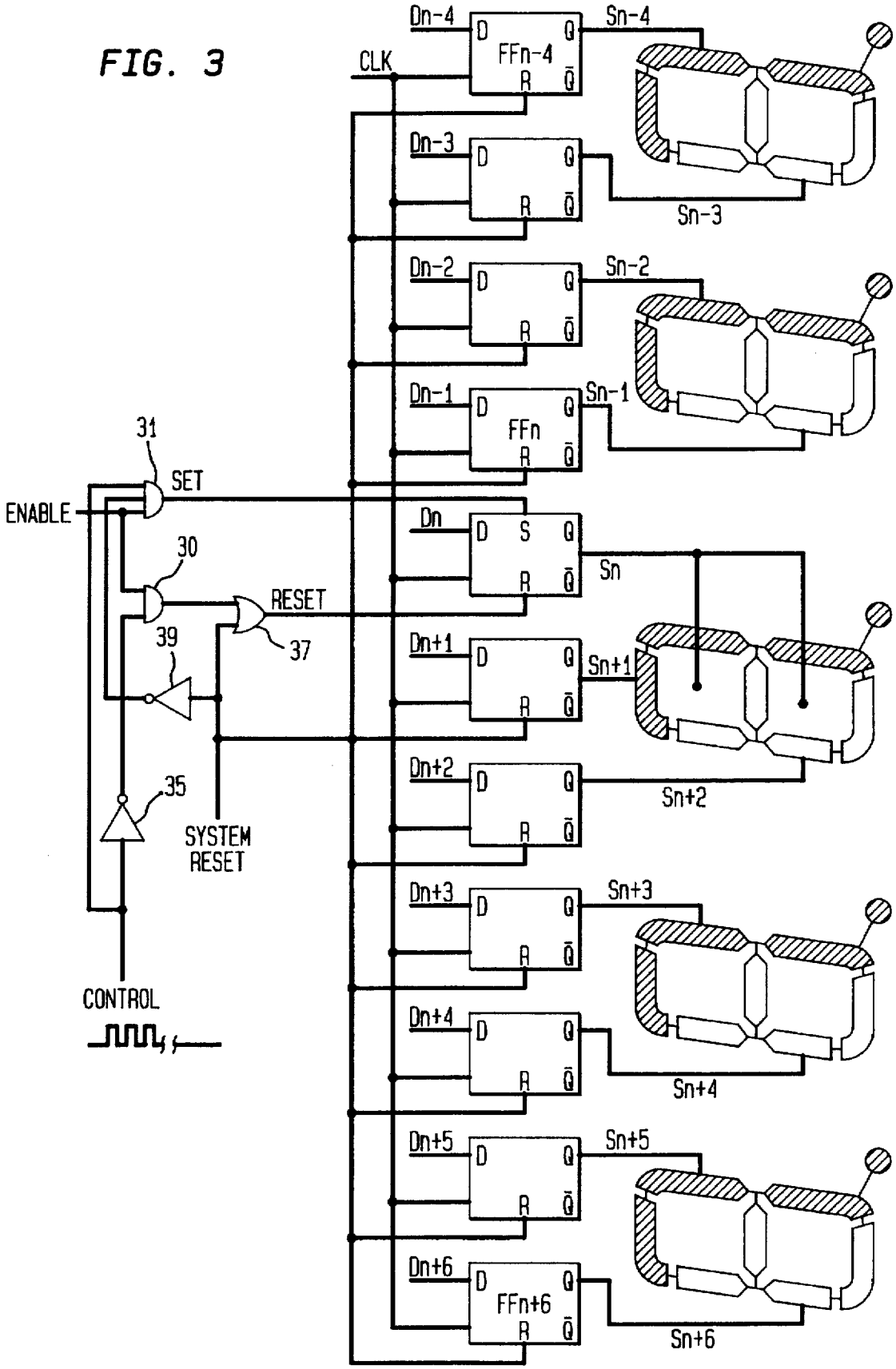
FIG. 3 illustrates the invention.

As illustrated in FIG. 3, the microprocessor (not shown) alters the outputs of the buffers via signal lines $D_{n-1}$, $D_n$, $D_{n+1}$, etc. In one preferred embodiment, the flip-flop is used as the buffer. In FIG. 3, the output Sn of flip-flop $FF_n$ controls ":" symbol; the outputs $S_{n+1}$, $S_{n+2}$ of buffers $FF_{n+1}$, $FF_{n+2}$ control the third decimal digit; the output $S_{n+3}$, $S_{n+4}$ of buffers $FF_{n+3}$, $FF_{n+4}$ control the fourth decimal digit; the output $S_{n+5}$, $S_{n+6}$ of buffers $FF_{n+5}$, $FF_{n+6}$ control the fifth decimal digit; the output $S_{n-1}$, $S_{n-2}$ of buffers $FF_{n-1}$, $FF_{n-2}$ control the second decimal digit; the output $S_{n-3}$, $S_{n-4}$ of buffers $FF_{n-3}$, $FF_{n-4}$ control the first decimal digit. When these five digits are programmed to display the time information, the output $S_{n+1}$, $S_{n+2}$ of $FF_{n+1}$, $FF_{n+2}$ are such that the third digit is always dark.

The operation of set or reset of the buffer mentioned above may be triggered by an external circuit as shown in FIG. 3. The drive circuit includes a first AND gate 31, a second AND gate 33, a first NOT gate 35, a second NOT gate 39, an OR gate 37. The first AND gate 31 inputs an enable signal, a control signal which may be retrieved from the output of a counter within the microprocessor. The output of the first AND gate 31 is connected to the set terminal of the flip-flop $FF_n$. The second AND gate 33 inputs the enable signal and the inversion of the control signal. The output of second AND gate 33 connects to the OR gate 37, and another input of OR gate 37 is system reset signal. The second NOT gate 39 inputs the system reset signal and the output thereof is the third input of the first AND gate 31. By this arrangement, as the system reset signal and control signal are asserted at the same time, the flip-flop $FF_n$ will not output logic HIGH. The OR gate 37 outputs a reset signal to the reset terminal of the flip-flop $FF_n$. As the system reset signal is asserted, all flip-flops are reset to zero. As the enable signal and the control signal are asserted at the same time, flip-flop $FF_n$ outputs logic HIGH which lights up the symbol ":"; as the enable signal is asserted while the control signal is de-asserted, the flip-flop $FF_n$ outputs logic LOW which darkens the symbol ":". By this way, even when the microprocessor in sleep or standby modes to save battery power consumption, the flickering effect of the symbol ":" is still achieved.

What is claimed is:

1. A drive circuit for a decimal digit display, said decimal digit display includes a plurality of display units of seven-segment and a display unit of a partition symbol, each of the plurality of display units including a first display portion and a second display portion, and, responsive to a set of signals, the first display portion and the second display portion being enabled to display, the drive circuit comprising:

at least a pair of buffers, each of which storing the set of signals;

a partition symbol display buffer, having an output value controlling display of the display unit of partition symbol;

a control circuit for resetting and setting the partition symbol display buffer in accordance with a predetermined manner thereby causing the display unit of partition symbol to display intermittently.

2. The drive circuit as recited in claim 1, wherein the control circuit comprising:

a first NOT gate, responsive to a control signal, outputting a first inversion signal;

a second NOT gate, responsive to a system reset signal, outputting a second inversion signal;

a first AND gate having an output line, the first AND gate inputting an enable signal, the control signal and the second inversion signal, the output line being coupled to a set terminal of the partition symbol display buffer;

a second AND gate for generating an output signal by inputting the enable signal and the first inversion signal;

an OR gate for generating a reset signal to a reset terminal of the partition symbol display buffer by inputting the output signal of the second AND gate and the system reset signal.

* * * * *